US005186980A

United States Patent [19]

Koschitzky

[11] Patent Number: 5,186,980

[45] Date of Patent: Feb. 16, 1993

[54] ROOFING SHINGLES AND METHOD OF MAKING SAME

[75] Inventor: Henry Koschitzky, Downsview, Canada

[73] Assignee: Iko Industries Ltd, Toronto, Canada

[21] Appl. No.: 783,594

[22] Filed: Oct. 28, 1991

[30] Foreign Application Priority Data

Sep. 23, 1991 [CA] Canada ..... 2052083

[51] Int. Cl.[5] ..... B05D 1/12; B32B 11/02

[52] U.S. Cl. ..... 427/187; 427/188; 428/143; 52/554

[58] Field of Search ..... 206/323, 324; 427/293, 427/187, 188; 428/143, 147-149; 52/554, 555

[56] References Cited

U.S. PATENT DOCUMENTS 1,666,429 4/1928 Stolp, Jr. ..... 206/323
2,111,761 3/1938 Eckert ..... 427/188
4,352,837 10/1982 Kopenhaven ..... 427/197 X

*Primary Examiner*—Evan Lawrence

*Attorney, Agent, or Firm*—Bereskin & Parr

[57] ABSTRACT

A method of making roofing shingles in several lanes in which, after the asphalt saturated base sheet is covered with a first granule layer, a pattern of asphalt patches is printed on each lane and contrasting color granules are adhered to the patches. Each patch pattern repeats each shingle length but is non-symmetric about the center line of the length of each shingle. When the sheet is cut into shingles, the shingles from each lane have a different patch pattern from the other lanes. The shingles are assembled in bundles containing shingles from at least two lanes and approximately equal numbers of the patch patterns are located on opposite sides of the bundle to make sure the bundle is not tilted. The patch pattern is such that when each shingle is cut into tabs (thirds), at least one and preferably two tabs from each shingle has its center free of patches, enabling the tab to bend over a ridge with less risk of cracking. Preferably no patches are located at the lines where the shingles are cut into tabs.

14 Claims, 6 Drawing Sheets

ROOFING SHINGLES AND METHOD OF MAKING SAME

FIELD OF THE INVENTION

This invention relates to a method for making roofing shingles, and to roofing shingles so made.

BACKGROUND OF THE INVENTION

Asphalt roofing shingles are manufactured by taking a continuous base sheet of organic felt or fibreglass, saturating it in a base asphalt, covering it with a coating asphalt, and then embedding granules on the top side of the coated sheet. The granules protect the asphalt from breaking down through oxidization by ultra violet rays. The finished sheet is cut into lanes and to a desired length of shingles.

The granules are applied with a pattern of colored blends that repeat over several shingles. This pattern allows for a colorful and decorative capping for the house yet ideally prevents any undesired repetitive patterns from forming on the roof once the shingles are installed. In some cases, it is desired to provide additional decoration by providing a second layer of asphalt coating to portions of the exposed parts of the shingle and then embedding granules in these patches of fresh asphalt. These patches of asphalt and granules allow for two contrasting colors on top of each other to add to the variety of the shingle appearance.

In the past, the patches of contrasting color granules have often been applied in a regular pattern which is the same on each shingle. A difficulty with this is that when the shingles are installed, the resultant pattern is repetitious or uniform and may not be sufficiently attractive.

U.S. Pat. No. 4,352,837 issued Oct. 5, 1982 to Certain-Teed Corporation suggests a way of dealing with this problem. In the Certain-Teed patent, a series of spaced apart bands or patches of granules are applied as a second layer to the first uniform layer of granules, the patches of the second layer having various widths and being applied with a periodicity different from the shingle length. This results in a random appearance since the same pattern does not repeat on any two shingles for a relatively large number of shingles.

When the random method described above is used for applying a second layer of asphalt and granule patches, the roofer can experience difficulty while applying capping and ridges. When a roofer applies capping and ridges, he usually cuts the shingles into thirds (called tabs) and bends the tabs over the peak. If a patch, ie. a second layer of asphalt and granules, is on the apex of the ridge, it will tend to crack as the tab is bent over the ridge. Therefore, preferably the roofer should have a series of shingles available which do not have patches at the centers of the tabs. However, when the pattern of patches is relatively random, the roofer will not usually be able to find sufficient such shingles, at least not without a great deal of looking.

It is therefore an object of the invention to provide a method of making shingles which achieves a variable arrangement of pattern and yet which at the same time also provides groups of shingles which are identical. Thus a roofer can use such shingles to produce a roof which will have a pleasing appearance, and yet it is possible, using such a method, to produce shingles where at least one or two thirds of such shingle (ie. one or two tabs) do not have patches (ie. second layers of asphalt and granules) at their centers. This will permit less waste and allows the roofer to help ensure that caps and ridges are properly installed.

BRIEF SUMMARY OF THE INVENTION

Accordingly, in one of its aspects the present invention provides:

A method of making roofing shingles, comprising:

providing a strip formed of a base material saturated with a coating material and having a first layer of granules adhered on said coating material, said strip having the width of a plurality of shingles and having a plurality of lanes, one lane corresponding to each of a plurality of set of shingles to be produced, printing on top of said first layer of granules of each lane a pattern of spaced apart patches of coating material, the pattern of patches for each lane being different in appearance from that of the pattern of patches for each other lane when the shingles are viewed when they have a common orientation, the repeat length of each pattern of bars being the same as the length of an integral number of shingles, adhering to said patches granules of a color different from the color of said first layer of granules, cutting said strip into shingles, and packing said shingles in bundles with each bundle containing some shingles from one lane and some shingles from at least one other lane, whereby to provide a varied appearance for the shingles of a bundle when installed on a roof while at the same time ensuring that at least some shingles in each bundle are substantially identical.

Further objects and advantages of the invention will appear from the following description, taken together with the accompanying drawings.

DETAILED DESCRIPTION OF THE PREFERRED EMBODIMENT

Figure 1:
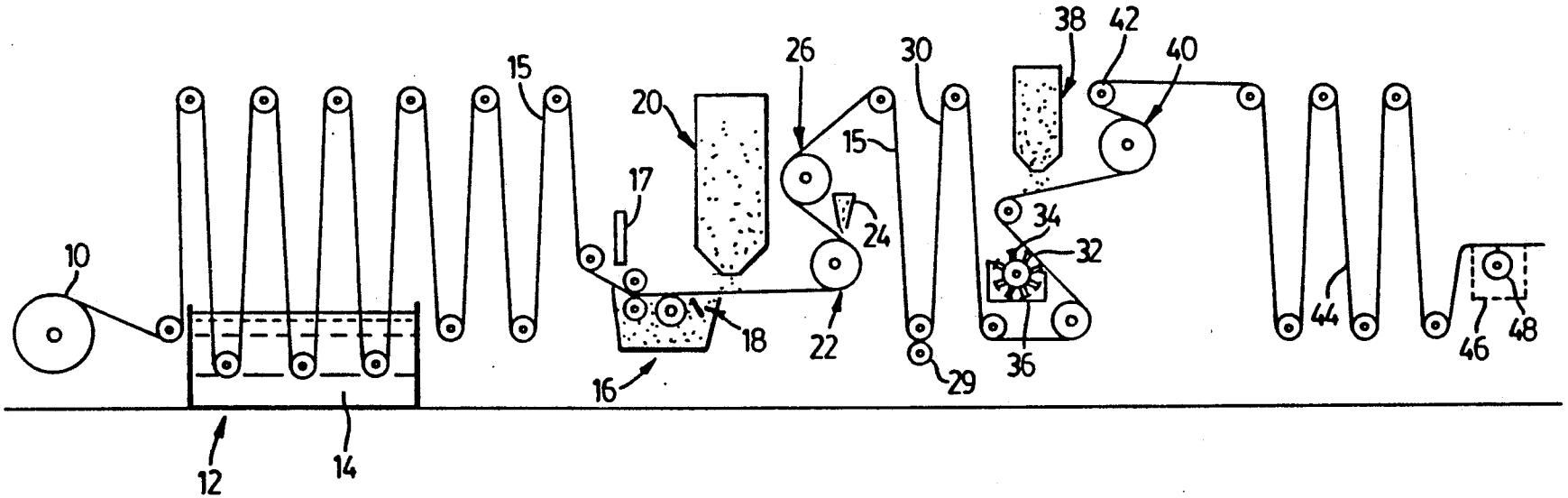
FIG. 1 (PRIOR ART)
FIG. 1 a diagrammatic schematic view of a conventional production line for producing roofing shingles.

Reference is first made to FIG. 1, which shows diagrammatically a production line for producing roofing shingles. The production line of FIG. 1 is entirely conventional and therefore will be described only briefly.

FIG. 1 shows a roll 10 of organic felt or fibreglass mat. The felt is unrolled and dipped several times into saturator tank 12 which contains saturant asphalt 14 at a temperature of approximately 450° F. If fibreglass mat is used, it passes over the saturator and does not come in contact with the saturant 14. The sheet, indicated at 15, is then passed through a coating tank 16 where it is covered with coating asphalt mixed with filler at a temperature of 400° F. The coating asphalt can be applied from applicator 17.

The coating asphalt is used mainly to hold the granules on the exposed surface. A scraper 18 is used to remove the excess coating asphalt from the back of the sheet 15, the excess being returned to the tank 16. While the top coating of the sheet is still hot, a sequence of colored blends of granules from hopper 20 are dropped on top and then the sheet goes around a slate drum 22. Talc is added to the back of the sheet from hopper 24 to prevent the sheet from sticking to the rolls or while in the bundles, and then the sheet passes over a talc roll 26 which embeds the talc.

The sheet 15 next passes through press rolls 29 which embed the granules. The sheet 15 then enters a cooling section 30 where it is cooled with air fans and water sprays (not shown). The exposed or upper surface of the sheet then passes over a print wheel 32 which applies patches of filled coating asphalt at 400° F. by dipping pads 34 on the outer surface of the print wheel into a small coating tank 36. After the sheet has passed under the print wheel, granules from hopper 38 are immediately applied over the entire sheet but adhere only to the asphalt patches. The sheet then travels over a slate drum 40 and then goes around a press roll 42 so the granules are immediately embedded in the asphalt patches. The sheet then enters a finish product looper 44 where it accumulates and is allowed to cool further to approximately 100° F. by air fans (not shown). The sheet then enters a cutting section 46 which cuts the sheet into four parallel lanes, and also, using a cutter 48, cuts the sheet to desired lengths.

Figure 2:
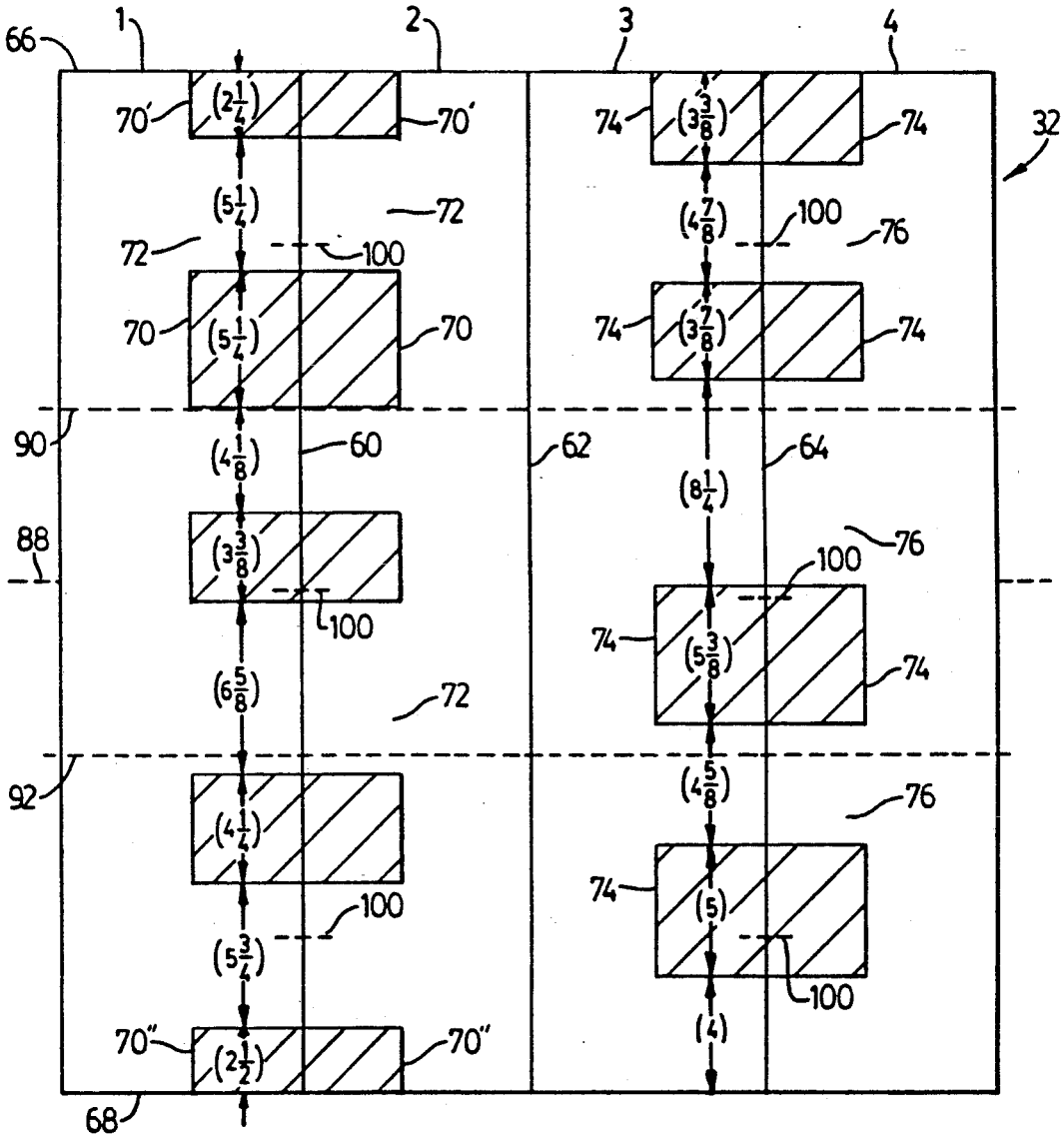
FIG. 2 is a plan view of four lanes of shingles according to the invention.

It is conventional to produce shingles in four lanes, i.e. the sheet 15 is normally the width of four shingles. The four lanes are shown in FIG. 2 and are marked as 1, 2, 3 and 4. The lines along which the lanes will be cut to divide them into separate strips are shown at 60, 62 and 64. The lines along which the shingles will be cut transversely to produce shingles of standard length are shown at 66, 68. FIG. 2 thus shows a portion of sheet 10 which is one shingle in length, typically one meter.

As shown, lanes 1 and 2 have printed thereon a series of patches 70 separated by spaces 72. The patches 70 are printed on the bottom portions of the shingles, i.e. the portion which will be visible when the shingles are installed. Lanes 3 and 4 have printed thereon a different series of patches 74 separated by spaces 76. Typical exemplary dimensions for patches 70, 74 and spaces 72, 76 are shown in parenthesis in the drawings. It will be seen that the series or cycle represented by patches 70 and spaces 72 is different from that represented by patches 74 and spaces 76. However each series or cycle has in common that it is exactly one shingle in length, i.e. (for example) 39⅛" (one meter) in length. Thus the pattern in lanes 1, 2 and that in lanes 3, 4 repeats each shingle length.

Figure 3:
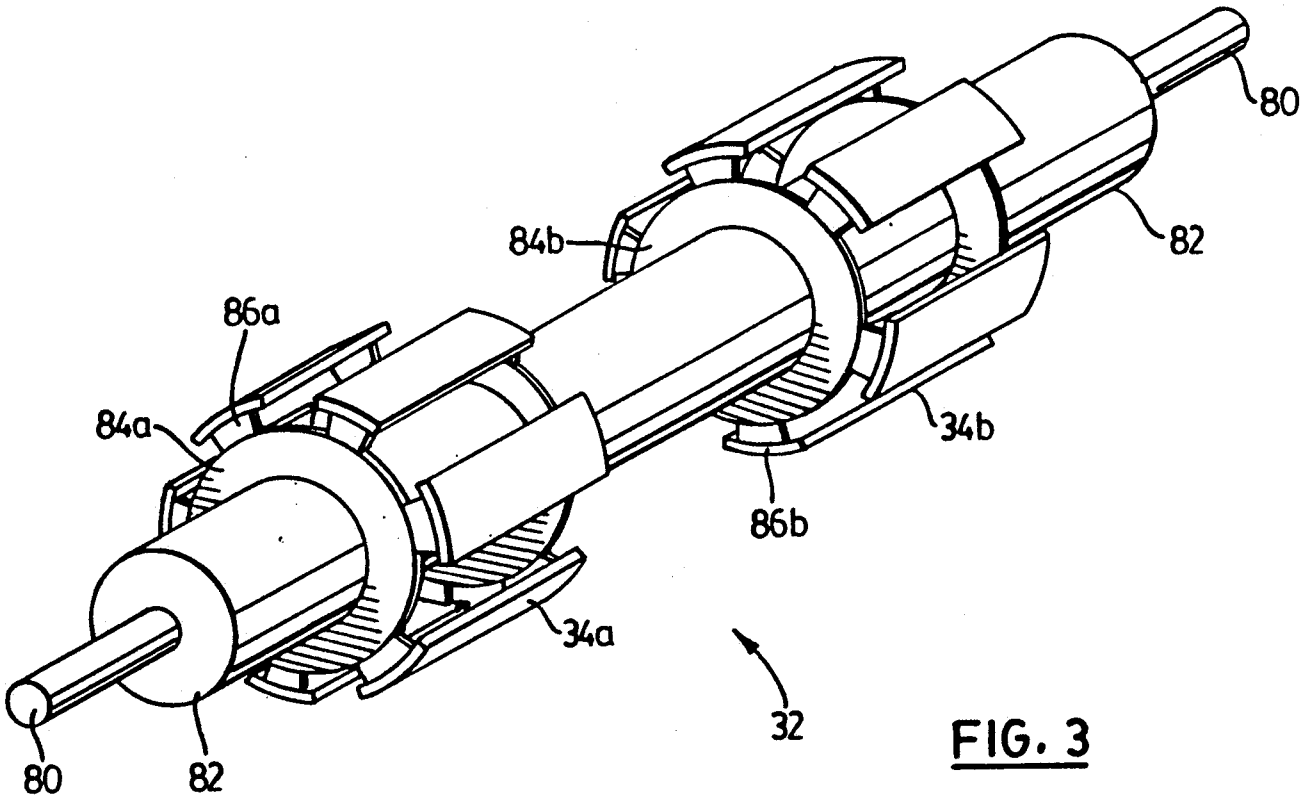
FIG. 3 is a perspective view of a print wheel used to produce the pattern shown in FIG. 2.

A typical print wheel 32 to achieve the above described pattern is shown in FIG. 3. As shown, print wheel 32 has a shaft 80 driven at the actual speed of the main line, ie. the sheet 15. Mounted to the shaft 80 is a drum 82 for stability purposes and mounted to the drum 82 are two sets of rings 84*a*, 84*b*. Bolted to the rings 84*a*, 84*b* are radial spokes 86*a*, 86*b*. The pads 34*a*, 34*b*, which create the patch pattern when dipped in asphalt, are bolted to the radial spokes 86*a*, 86*b* and are thus spaced from the rings. The circumferential widths of pads 34*a*, 34*b* correspond to the widths of the patches 70, 74 in FIG. 2 and the circumferentially spaces between the pads correspond to the spaces between the patches 70, 74 in FIG. 2. Since patch 70′ and patch 70″ are at opposite ends of the shingle, they can be printed together by one of the pads 34*a*.

It will be seen that only two different sets of pads 34*a*, 34*b* are required to make four distinct shingles since the lane divisions 60, 62, 64 are cut down the center of the patches. It will also be noted that the pattern in lanes 1 and 2 is not symmetric about the center line 88 of the length of the shingle. Thus, when line 88 is drawn bisecting the length of the shingles into two portions, the pattern in lanes 1 and 2 on one side of line 88 is not the same as that on the other side of line 88. The same applies to lanes 3 and 4. It will be seen that this is important when the shingles are later assembled into bundles.

Figure 4:
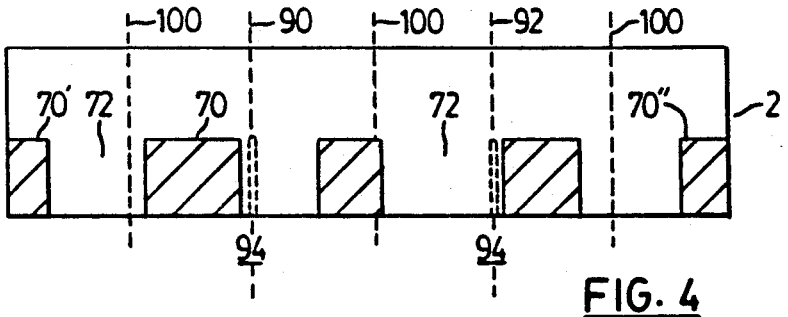
FIG. 4 is a plan view of a shingle from lane 2.

When the shingles are to be used for a peak or ridge, they are usually cut into thirds (called tabs), as indicated by lines 90, 92 in FIG. 2. The thirds or tabs are usually defined by narrow cutouts, shown at 94 in one shingle 2 (from lane 2) in FIG. 4. Preferably no patches are located at the lines 90, 92 since locating patches there may make the shingle more difficult to cut. In addition, if there were a patch at line 90 or 92, cutting into tabs at these lines may leave a narrow portion of a patch at one side of the cut, which may be unsightly.

Figure 5:
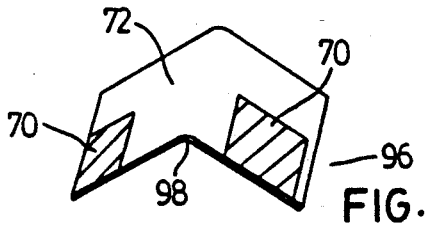
FIG. 5 is a perspective view of a tab from the shingle of FIG. 4, to fit over a peak or ridge.

After the shingle is cut into tabs, the tabs, one of which is indicated at 96 in FIG. 5, are bent over the peak or ridge to be covered. The bend is shown at 98 in FIG. 5. Preferably no patch is located on bend 98 since a patch there would tend to crack. Therefore, in each shingle from each lane, preferably one or two of the tabs does not have a patch at its center. For example, in FIG. 2, the center of each third or tab is marked at 100. It will be seen that in lanes 1 and 2, no patches occur at the centers 100. In lanes 3 and 4, no patches occur at one of the centers 100 but do occur at the other two centers. Thus a roofer will be able to find in every bundle of shingles at least some where no patches occur at the centers of the tabs (as will be described).

Figure 6:
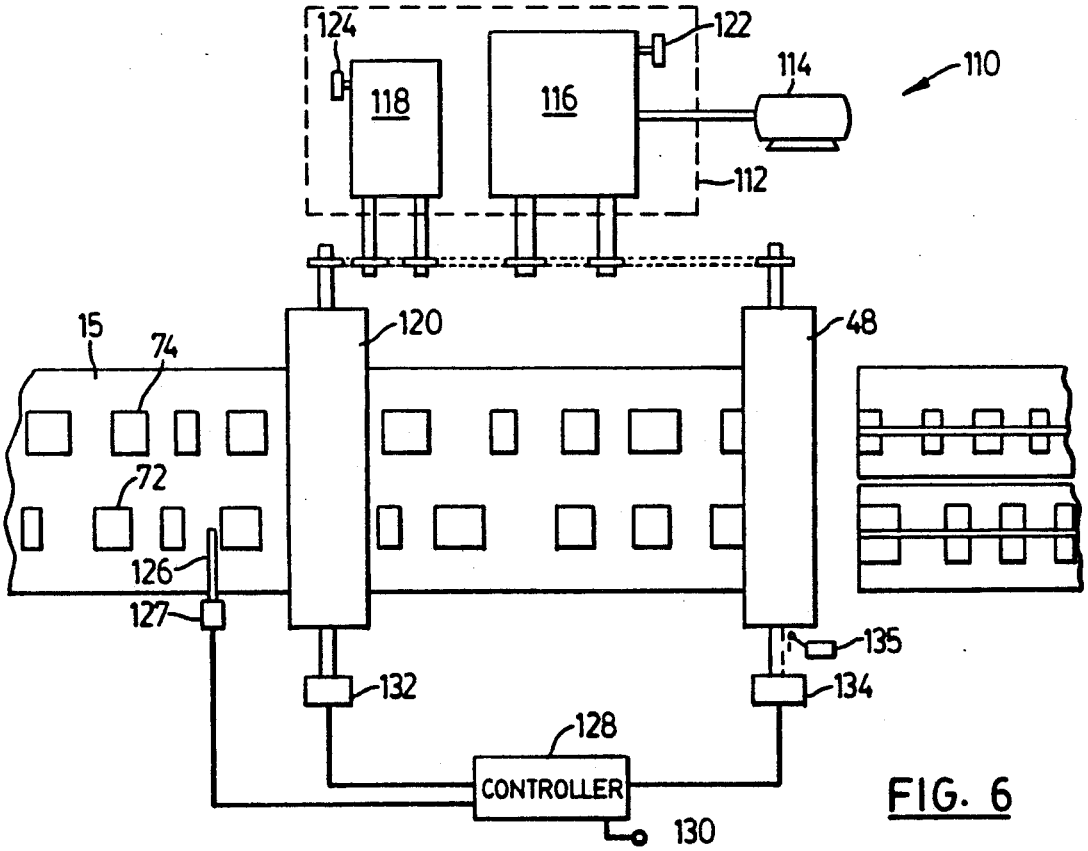
FIG. 6 is a diagrammatic view of a length and phase controller for cutting shingles.

When the sheet 15 reaches the cutter 48, a controller 110 (FIG. 6) is used to ensure that the shingles are all of equal length, that the length of each shingle is equal to the length of the pattern, and that the cut between shingles is properly positioned relative to the pattern.

The controller 110 uses a standard differential variable chain drive transmission 112 sold under the trademark SPECON by Fairchild Industrial Products Company of Winston-Salem, North Carolina. The transmission 112 receives power from an electric motor 114 and transmits it through a variable speed pulleys and gearbox unit 116, and a differential 118, to pull rolls 120 which pull the sheet 15. The pull rolls 120, not shown in FIG. 1, are located just before cutter 48. Power is also applied through the variable pulleys and gearbox unit 116 to cutter 48. In use, the cutter 48 rotates at a fixed ratio relative to the speed of motor 114, and the speed of pull rolls 120 is adjusted by speed controller 122 until the proper length of shingles is achieved. Since the cutter 48 is subject to heavy wear, adjustments will be made periodically.

Once the proper length of shingle is set, the proper position (or phase) of the cut relative to the patch pattern must be set. This is achieved by using phase controller 124 to rotate one side of differential 118 (part of the "SPECON" transmission 112). This simply adds or subtracts part of a revolution from the output shaft of differential 118. In effect a length change of the shingles is made, spread over one or a few shingles, until the proper position or phase of cut relative to the patch pattern has been achieved.

To set up the system for the initial cut, the sheet 15 is positioned in the cutter 46 such that a timing mark on the cylinder of cutting knife 48 and identifying marks on the sheet 15 coincide. A patch sensor 126 is provided to continually determine the position of patches on the sheet 15. Patch sensor 126 is simply a trailing arm which detects a patch (by being lifted slightly by a patch passing beneath it) and operates a magnetic switch 127. Assuming that there are four patches to be printed per shingle and that print wheel 32 contains eight pads 34 (for printing two shingles in each revolution), sensor 126 will produce eight pulses for each revolution of the print wheel 32. These pulses are sent to a computerized controller 128 which is programmed for its operator to indicate at control 130 which is the "first" patch of the pattern. The following seven pulses from sensor 126 will be ignored but the ninth pulse will again be recognized as indicating the first patch of the next print wheel revolution.

In addition, pulse generators 132, 134 are connected to the shafts of pull roll 120 and knife 48 respectively, and generate a fixed number of pulses per revolution. A switch 135 generates a pulse to mark a "home" or known position for knife 48. All this information is fed into the controller 128.

By using the information from the patch sensor 126 and comparing it to the pulse count from the pull rolls 120, either the operator or the controller 128 can adjust speed controller 122 so as to match the shingle length with the patch pattern length. The controller 128 will continually monitor this relationship and make adjustments to the speed controller 122 as required to ensure that the length of each shingle remains identical with patch pattern length. The controller 128 has built-in alarm setpoints to alert the operator if excessive variation occurs.

When the shingle length is identical with the patch pattern length, the controller 128 then uses information from the knife position switch 135 and from the patch sensor 126 to determine the cut-off position (i.e. the location of the transverse cuts across the lanes) relative to the patch pattern. If an error in the position (i.e. phase) of the cut is detected, the controller 128 will make short term adjustments to phase controller 124. The phase position is of course continually monitored by controller 128.

Figure 7:
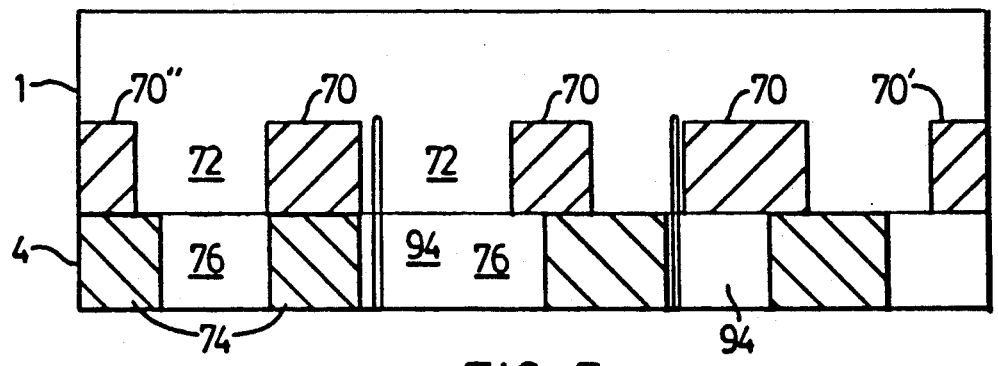
FIG. 7 shows shingles from lanes 1 and 4 superimposed one above the other so that the patterns on them can be compared.
Figure 8:
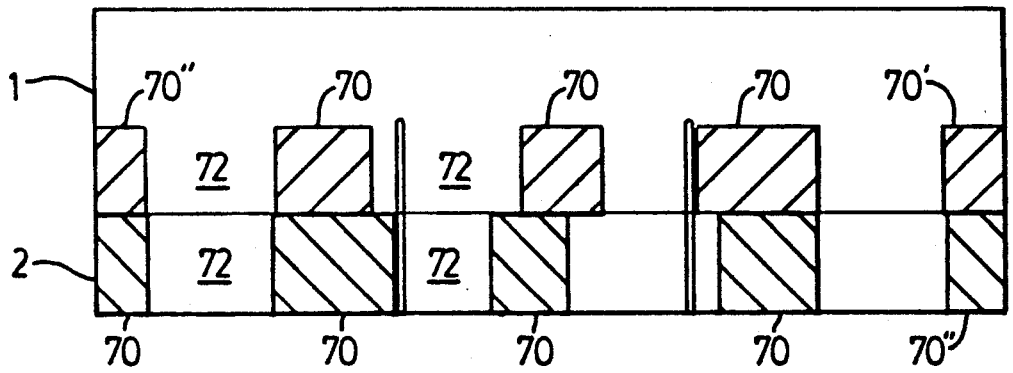
FIG. 8 shows shingles from lanes 1 and 2 superimposed one above the other so that the patterns on them can be compared.

The patterns produced by the process described are compared in FIGS. 7 and 8. In FIGS. 7 and 8, the patterns are compared by superimposing one shingle over another with both aligned lengthwise, but it will be realized that in actual use, the shingles will be offset from each other lengthwise.

FIG. 8 compares the patterns from lanes 1 and 4. As shown, the patches and spaces 70, 72 of lane 1 are quite different from patches and spaces 74, 76 of lane 4. Therefore, when they are used on adjacent portions of a roof, the effect will be relatively random and attractive.

FIG. 8 compares the patterns from lanes 1 and 2. Because the pattern is not symmetric about its center, and because the shingles from lane 2 must be rotated 180° to match those from lane 1 for installation, the patterns from lanes 1 and 2 again differ from each other, even though they were printed by the same print wheel pads 34*a*. Therefore, even when shingles from lanes 1 and 2 are installed side by side or one row above the other, they will present a varying and attractive appearance.

Figure 9:
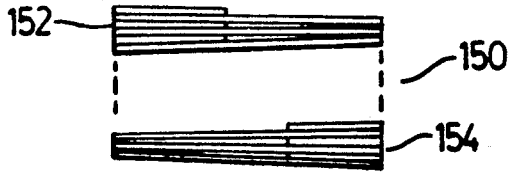
FIG. 9 shows a portion of a bundle of shingles formed according to the invention.

FIG. 9 shows a portion of a typical bundle 150 of shingles. The bundle 150 contains a combination of ten shingles 152 (from lanes 1 and/or 3) plus a combination of ten shingles 154 from lanes 2 and/or 4. It will be seen that since the patches 70 constitute layers of increased thickness, the bundle portion which is formed simply of shingles 152 (from lanes 1 and/or 3) is higher at one side than the other. However this is counteracted by including, in the bundle 150, shingles 154 from lanes 2 and/or 4 which have their patches 74 on the opposite side from patches 70 of lanes 1 and/or 3. The result is that the bundle 150 is of uniform height.

Figure 10:
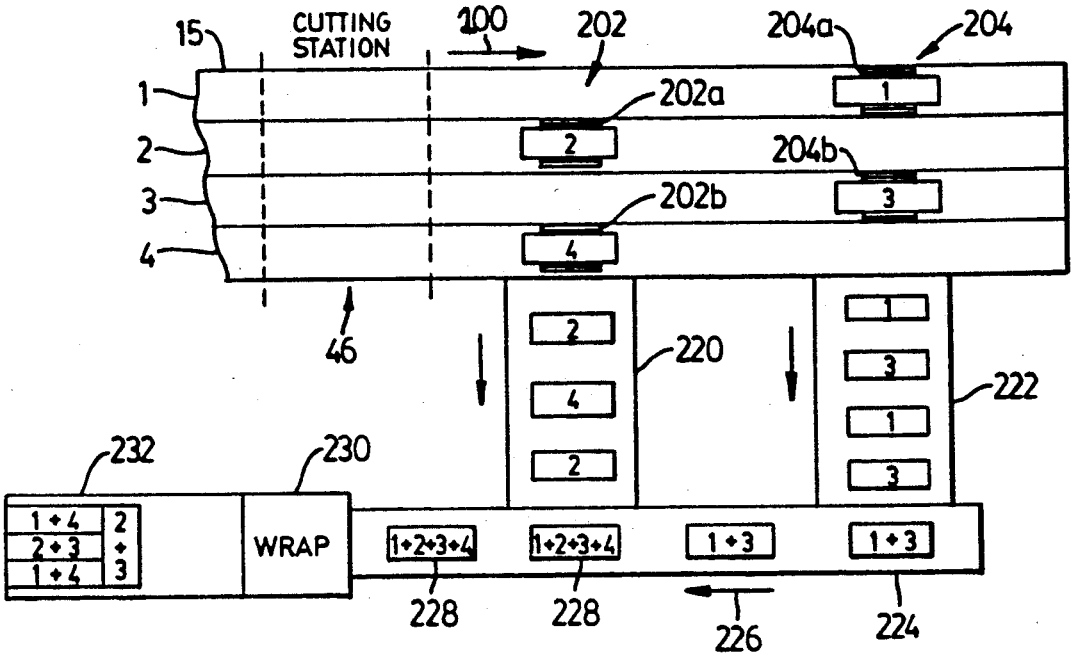
FIG. 10 is a diagrammatic schematic view showing cutting and movement of the shingles to assemble them in bundles according to the invention.
Figure 11:
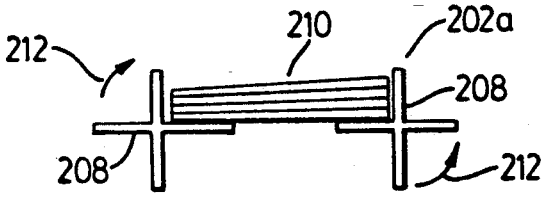
FIG. 11 (PRIOR ART)
FIG. 11 is an end view showing a conventional starwheel used in the arrangement of FIG. 10.
Figure 12:
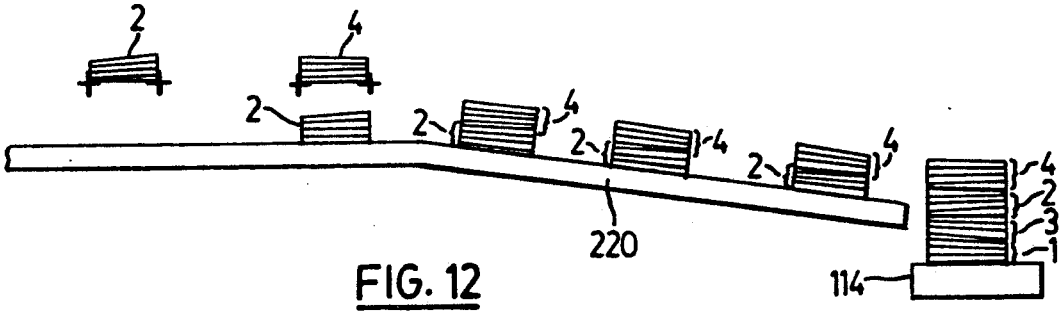
FIG. 12 is a side view showing conveyors used in the arrangement of FIG. 10.

A conveyor and packing arrangement to achieve a desired combination of shingles in bundles is shown in FIGS. 10 to 12. As shown in FIG. 10, the sheet 15, completed and ready to cut, moves to cutting station 46 where cutters (not shown) slit the sheet 15 into separate lanes 1 to 4 and where knife 48 cuts the shingles to length by cross-cutting the entire four lanes at distances corresponding to the length of a shingle.

In order to achieve maximum variability of pattern in each bundle, shingles from more than one lane are combined into each bundle. For example, when shingles from lanes 1 and/or 3 are combined with shingles from lanes 2 and/or 4, each bundle 150 will have a variety of patterns so that when the shingles are installed, the pattern of the resultant roof can be varied and attractive. At the same time, the bundles 150 will be uniform (ie. untilted), and yet the roofer will be able to find in each bundle a number of shingles where the patches are not at the centers of the tabs, so that a cap or ridge can be properly shingled.

In the example described below, it will be assumed that each bundle contains 20 shingles, composed of five shingles from each of lanes 1 to 4. It will be realized that these parameters can be varied. As the shingles are cut, they move in the direction of arrow 200 into one of two conventional starwheel stations 202, 204. Starwheel stations 202 has two sets of starwheels 202*a*, 202*b* for lanes 1 and 3 respectively. One starwheel 202*a* is shown diagrammatically in FIG. 11 and has conventional four bladed wheels 208 which under separate control accumulate a desired number of shingles 210 between them.

Each starwheel set can hold up to ten shingles, but in the FIGS. 10 to 12 arrangement, each collects five shingles. After each starwheel set has collected five shingles, it rotates 90° (eg. wheels 208 rotate in the direction of arrows 212 in FIG. 11), dropping their shingles onto transverse conveyors 220, 222 (FIGS. 10, 12) beneath them.

As shown, conveyor 220 receives sets of five shingles each from starwheel 202*a* (lane 2), and its speed is set so that sets of five shingles from starwheel 202*b* (lane 4) are dropped on top of the sets from lane 2. (Alternatively, conveyor 220 can simply receive alternating sets of ten shingles each from lanes 2 and 4.)

Similarly, conveyor 222 receives sets of five shingles each from starwheel 204*a* (lane 1), and its speed is set so that sets of five shingles from starwheel 204*b* (lane 3) are dropped on top of the sets from lane 1. (Alternatively, conveyor 212 can simply receive alternating sets of ten shingles each from lanes 1 and 3).

Conveyors 220, 222 discharge their sets of shingles onto another conveyor 224 moving in the direction of arrow 226, ie. transverse to conveyors 220, 222. Conveyor 222 discharges its sets of shingles directly onto conveyor 224, while conveyor 220 discharges its sets of shingles on top of those previously deposited by conveyor 222. For this purpose conveyor 220 is arranged at a higher level than conveyor 224, as shown in FIG. 12, so that it can discharge its sets of shingles at the correct height.

Thus, each final bundle of shingles 228 formed on conveyor 224 will have five shingles from each of lanes 1 to 4. If the alternative arrangement were used in which conveyors 220, 222 had alternating sets of ten shingles from lanes 2, 4 and 1, 3 respectively, then typically ten shingles from lane 2 would be deposited by conveyor 220 on top of ten shingles from lane 3 on conveyor 224, and ten shingles from lane 4 would be deposited by conveyor 220 on top of ten shingles from lane 1 on conveyor 224. The result would be alternating bundles on conveyor 224, some containing shingles from lanes 2 and 3 or 2 and 1 and some containing shingles from lanes 4 and 3 or 4 and 1.

The bundles 228 are wrapped and the wrapping is glued at station 230, and the wrapped bundles are then palletized at 232. Typically 60 bundles are placed on a pallet, but this number can change depending upon customer requirements.

While four lanes of shingles have been shown, this number can be changed if desired. It is also not necessary in all cases that the bundle be of the same thickness on each side. In addition, if desired the repeat length of each pattern of patches can be more than one shingle long, e.g. it can be two shingles long. However a repeat length of one shingle length is much preferred since this provides sufficient variation in pattern while ensuring that there are enough identical shingles for use when needed. It also simplifies the task of ensuring that at least some tabs of each shingle, or in each bundle, will not have patches at their centers. It further simplifies the task of trying to avoid patches at the lines 90, 92 where the shingles are to be cut into tabs.

While a preferred embodiment of the invention has been described, it is understood that the invention is not limited to the specific embodiment described and that various modifications will occur to those skilled in the art. All such modifications are intended to be included within the scope of the appended claims.

I claim:

1. A method of making roofing shingles, comprising: providing a strip formed of a base material saturated with a coating material and having a first layer of granules adhered on said coating material, said strip having the width of a plurality of shingles and having a plurality of lanes, one lane corresponding to each of a plurality of set of shingles to be produced, printing on top of said first layer of granules of each lane a pattern of spaced apart patches of coating material, the pattern of patches for each lane being different in appearance from that of the pattern of patches for each other lane when the shingles are viewed when they have a common orientation, the repeat length of each pattern of bars being the same as the length of an integral number of shingles, adhering to said patches granules of a color different from the color of said first layer of granules, cutting said strip into shingles, and packing said shingles in bundles with each bundle containing some shingles from one lane and some shingles from at least one other lane, whereby to provide a varied appearance for the shingles of a bundle when installed on a roof while at the same time ensuring that at least some shingles in each bundle are substantially identical.

2. The method according to claim 1 wherein said integral number is not greater than two.

3. The method according to claim 1 wherein said integral number is one.

4. The method according to claims 1, 2 or 3 wherein in at least some of said lanes, the pattern of patches on each shingle is such that when such shingle is cut transversely into a predetermined number of portions, at least some of such portions will have centers which are free of said patches, thus to facilitate bending such portions over a roof peak or ridge.

5. The method according to claim 3 wherein in each of said lanes, the pattern of patches is such that when said shingles are cut transversely into a predetermined number of portions, at least one of such portions of each shingle will have a center which is free of said patches, thus to facilitate bending such portions over a peak or ridge.

6. The method according to claim 5 wherein at least two said portions of each shingle have a center which is free of said patches.

7. The method according to claim 5 or 6 wherein said predetermined number is three.

8. The method according to claim 5 or 6 wherein said pattern of patches is formed so that there are no patches at the locations where said shingles are transversely cut into said portions.

9. The method according to claim 5 wherein there are four said lanes, the patches for the first and second lanes are printed together back to back as common patches, and the patches for the third and fourth lanes are printed together back to back as common patches, the pattern created by the patches for the first and second lanes being non-symmetric about a center line of the length of the shingles, the pattern created by the patches for the third and fourth lanes also being non-symmetric about a center line of the length of the shingles, so that when shingles from the first and second lanes are aligned for installation and when shingles from the third and fourth lanes are aligned for installation, the shingles from the first and second lanes will differ in appearance from each other and the shingles from the third and fourth lanes will differ in appearance from each other and from the appearance from the shingles in the first and second lanes.

10. The method according to claims 1, 3, 5 or 9 wherein the shingles from two of said lanes are collected in sets on a first conveyor, and shingles from two different lanes are collected in sets on a second conveyor, and wherein sets of shingles from one of the first and second conveyors are deposited onto a third conveyor to form a bundle portion, and sets of shingles from the other of the first and second conveyors are deposited one on top of each said bundle portion to form a complete bundle.

11. The method according to claims 1, 3, 5 or 9 wherein shingles from every lane are combined into each bundle.

12. A bundle of roofing shingles comprising at least first and second sets of shingles, each shingle having a base material saturated with a coating material and having a first layer of granules adhered on said coating material, each shingle also having a plurality of spaced apart patches of coating material printed on said first layer of granules at one edge of said shingle and a second layer of granules of a color contrasting with said first layer adhered to said patches, all of the shingles of said first set having the same first pattern of patches and all of the shingles of the second set having the same second pattern of patches, said second pattern being different from said first pattern, said first and second patterns of patches being such that when a shingle is cut into a predetermined number of portions, at least one such portion of each shingle will have a center which is free of said patches thus to facilitate bending such portion over a peak or ridge, the shingles of said first set having said one edge at one side of said bundle and the shingles of said second set having said one edge at a side of said bundle opposite said one side.

13. A bundle of shingles according to claim 12 wherein said pattern of patches is formed such that there are no patches at the locations where said shingles are transversely cut into said portions.

14. A bundle of shingles according to claim 11 or 12 wherein there are at least four said sets of shingles in said bundle, the shingles of each set having a pattern of patches different from the pattern of patches on the shingles of each other set.

* * * * *